US010455327B2

(12) United States Patent
Oswald et al.

(10) Patent No.: US 10,455,327 B2
(45) Date of Patent: Oct. 22, 2019

(54) BINAURAL MEASUREMENT SYSTEM

(71) Applicant: Bose Corporation, Framingham, MA (US)

(72) Inventors: Charles Terence Henry Oswald, Salem, NY (US); Muhammad Haris Usmani, Dover, MA (US); Daniel Ross Tengelsen, Framingham, MA (US); Ryan C. Struzik, Hopkinton, MA (US); Christopher B. Ickler, Sudbury, MA (US); Tobe Zetelmo Barksdale, Bolton, MA (US); Michael James Tiene, Bellingham, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 15/837,214

(22) Filed: Dec. 11, 2017

(65) Prior Publication Data

US 2019/0182594 A1 Jun. 13, 2019

(51) Int. Cl.
*H04R 5/027* (2006.01)
*H04S 7/00* (2006.01)

(52) U.S. Cl.
CPC ..... *H04R 5/027* (2013.01); *H04S 7/303* (2013.01); *H04S 7/306* (2013.01); *H04S 2420/01* (2013.01)

(58) Field of Classification Search
CPC . H04R 5/00; H04R 5/02; H04R 5/027; H04R 5/033; H04R 1/10; H04R 1/028; H04R 1/222; H04R 1/326; H04R 25/00; H04R 3/005; H04R 5/04; H04R 1/1016; H04R 1/34; H04R 1/02; H04R 1/28; H04R 1/08; H04R 1/1075; H04R 1/14; H04R 1/46; H04S 7/00; H04S 7/30; H04S 7/301–7/307; H04S 2420/00; H04S 2420/01; H04W 4/80; A61F 2/18
(Continued)

(56) References Cited

U.S. PATENT DOCUMENTS 4,119,798 A * 10/1978 Iwahara ..... H04S 3/002 381/19
4,631,962 A * 12/1986 Genuit ..... H04R 5/027 434/270

(Continued)

FOREIGN PATENT DOCUMENTS

JP S5480703 A 6/1979
JP 2005102032 A 4/2005
JP 2005328315 A 11/2005

OTHER PUBLICATIONS

D1520e1, "Data Sheet" of the product HSM V, D1520e1, Dec. 2010, IDS filed on Apr. 9, 2019 (Year: 2010).*

(Continued)

*Primary Examiner* — Leshui Zhang
(74) *Attorney, Agent, or Firm* — Hoffman Warnick LLC

(57) ABSTRACT

Various implementations include systems and approaches for binaural testing. In one implementation, a system includes a binaural test dummy including a body having: a head-and-neck region; and a set of head-mounted microphones coupled with the head-and-neck region at anatomically correct ear locations; and a control system coupled with the binaural test dummy for incrementally modifying a position of the binaural test dummy across a range of motion.

24 Claims, 3 Drawing Sheets

(58) Field of Classification Search
USPC ..... 381/26, 309, 74, 56–61, 92, 91, 381/94.1–94.9, 120, 121, 122, 123, 119; 700/94
See application file for complete search history.

(56) References Cited

U.S. PATENT DOCUMENTS 4,819,270 A * 4/1989 Lombardo ..... H04R 1/08 381/26
2003/0147539 A1* 8/2003 Elko ..... H04R 3/005 381/92
2004/0136538 A1* 7/2004 Cohen ..... H04S 1/005 381/17
2006/0126855 A1* 6/2006 Geiger ..... H04R 5/027 381/56
2007/0297621 A1* 12/2007 Joublin ..... B25J 13/003 381/74
2014/0198918 A1 7/2014 Li et al.
2015/0365765 A1* 12/2015 Gwon ..... H04R 5/033 381/309
2018/0063641 A1* 3/2018 Lyren ..... H04R 5/027

OTHER PUBLICATIONS

Lindau et al, "FABIAN—An instrument for software-based measurement of binaural room impulse responses in multiple degrees of freedom", Nov. 1, 2006, XP055566808, included in the IDS filed on Apr. 9, 2019 and retrieved from Internet, May 2, 2014, pp. 1-5 (Year: 2006).*
International Search Report and Written Opinion for International Application No. PCT/US2018/064643, dated Mar. 20, 2019, 50 pages.
Lindau et al., "FABIAN—An instrument for software-based measurement of binaural room impulse responses in multiple degrees of freedom," Tonmeistertagung—VDT International Convention, Nov. 2006, 6 pages.
Head Acoustics : Overview Standard Delivery Items: HSM V (Code 1520) Head Seat Mount Adapter for the HMS IV Artificial Head Measurement System, Dec. 1, 2010, 50 pages.

* cited by examiner

BINAURAL MEASUREMENT SYSTEM

TECHNICAL FIELD

This disclosure generally relates to binaural testing. More particularly, the disclosure relates to systems and approaches for binaural testing in an environment.

BACKGROUND

Binaural sound is used to produce three-dimensional sound effects for a human listener in a particular environment. Binaural testing can be used to assess how a human user will perceive sound in the environment, and this test data can be utilized to enhance or otherwise control audio output within that environment. Conventional binaural testing is performed using an apparatus having microphones arranged within a set of replica pinna, intended to mimic the transfer function to the human ear. However, these conventional apparatuses are unwieldy, and require significant effort, repositioning and calculation to control and utilize in an effective manner.

SUMMARY

All examples and features mentioned below can be combined in any technically possible way.

Various implementations include systems and methods for binaural testing. In some implementations, the binaural testing systems includes a controllable binaural test dummy for conducting binaural testing across a range of motion in an environment.

In some particular aspects, a system includes: a binaural test dummy with a body having: a head-and-neck region; and a set of head-mounted microphones coupled with the head-and-neck region at anatomically correct ear locations; and a control system coupled with the binaural test dummy for incrementally modifying a position of the binaural test dummy across a range of motion.

In additional particular aspects, a method includes: positioning a binaural measurement system in a testing environment, the binaural measurement system including: a binaural test dummy with a body having: a head-and-neck region; and a set of head-mounted microphones coupled with the head-and-neck region at anatomically correct ear locations; and a control system coupled with the binaural test dummy; and actuating the control system to initiate audio sampling at the set of head-mounted microphones in the testing environment across a plurality of positions.

In other particular aspects, a binaural test dummy includes: a body having an anatomically correct head-and-neck region; and a set of head-mounted microphones coupled with the head-and-neck region of the body at anatomically correct ear locations, where the set of head-mounted microphones are directionally indifferent receptors for acoustic signals.

In other particular aspects, a system includes: a binaural test dummy having: a body; and a set of demountable microphones coupled with the body, wherein a configuration of the set of demountable microphones is modifiable to change at least one of a location, an orientation, a type or a number of the set of demountable microphones.

Implementations may include one of the following features, or any combination thereof.

In certain aspects, the range of motion mimics movement of a human in an intended environment, and includes at least one of: rotation, pitch, roll or tilt of the body, or positioning at least one leg or at least one arm on the body. In particular cases, the control system is configured to: modify the position of the binaural test dummy across a plurality of positions in the range of motion; and measure a transfer function of an acoustic signal received at the set of head-mounted microphones at the plurality of positions.

In particular implementations, the binaural test dummy further includes: a base; and a movable mount coupled with the base and the body. In some cases, the base is sized to conform to a seat cushion in a testing environment across the range of motion. In certain aspects, the body further includes: a thorax region coupled with the movable mount; and a shoulder region between the thorax region and the head-and-neck region.

In some cases, a region of the binaural test dummy includes a non-rigid material configured to approximate an acoustic impedance and absorption of a reference human being.

In particular implementations, the head-and-neck region has a set of openings corresponding with the anatomically correct ear locations, and the set of head-mounted microphones are demountably coupled with the set of openings.

In certain aspects, the set of head-mounted microphones includes two microphones each located at one of the anatomically correct ear locations.

In some cases, the system further includes at least one additional head-mounted microphone coupled with the head-and-neck region at a distinct location from each of the set of head-mounted microphones. In particular implementations, the additional head-mounted microphone is horizontally offset from the set of head-mounted microphones. In other particular implementations, the additional head-mounted microphone is vertically offset from the set of head-mounted microphones.

In certain cases, the control system is coupled with a base of the binaural test dummy, and the control system further includes: a user interface configured to enable direct control of the binaural test dummy, or an application programming interface configured to communicate with an acoustic measurement system.

In some implementations, the set of head-mounted microphones are mounted approximately flush with an outer surface of the head-and-neck region. In certain cases, the set of head-mounted microphones protrude from, or are inset from, the outer surface of the head-and-neck region by less than approximately one-quarter of a wavelength of a maximum frequency of a test signal.

In particular aspects, the control system further includes: a signal analyzer for analyzing an acoustic signal sampled at the set of head-mounted microphones, where the set of head-mounted microphones permits the signal analyzer to analyze the sampled acoustic signal without a corresponding free-field microphone measurement sample and without regard to a direction of a source of the acoustic signal. In certain implementations, the control system is configured to: control a movement of the binaural test dummy across a plurality of positions; and initiate the sampling of the acoustic signal after positioning the binaural test dummy at each of the plurality of positions.

In some cases, the control system is programmed to incrementally modify a position of at least one of the movable mounts or the body across a range of motion.

In particular implementations, the shoulder region includes an acoustically absorptive material.

In certain cases, an acoustically absorptive material on the binaural testing dummy is demountable to adjust an acoustic characteristic of the body.

In some aspects, the set of demountable microphones includes at least one of a flush-mounted microphone or a pinna-based microphone.

In particular cases, a configuration of the set of demountable microphones is modifiable to change at least one of a location, an orientation, a type or a number of the set of demountable microphones.

In some aspects, the system further includes a control sub-system coupled with the binaural test dummy, where the control sub-system is configured to modify at least one of a location or an orientation of the set of head-mounted microphones.

Two or more features described in this disclosure, including those described in this summary section, may be combined to form implementations not specifically described herein.

The details of one or more implementations are set forth in the accompanying drawings and the description below. Other features, objects and benefits will be apparent from the description and drawings, and from the claims.

Figure 1:
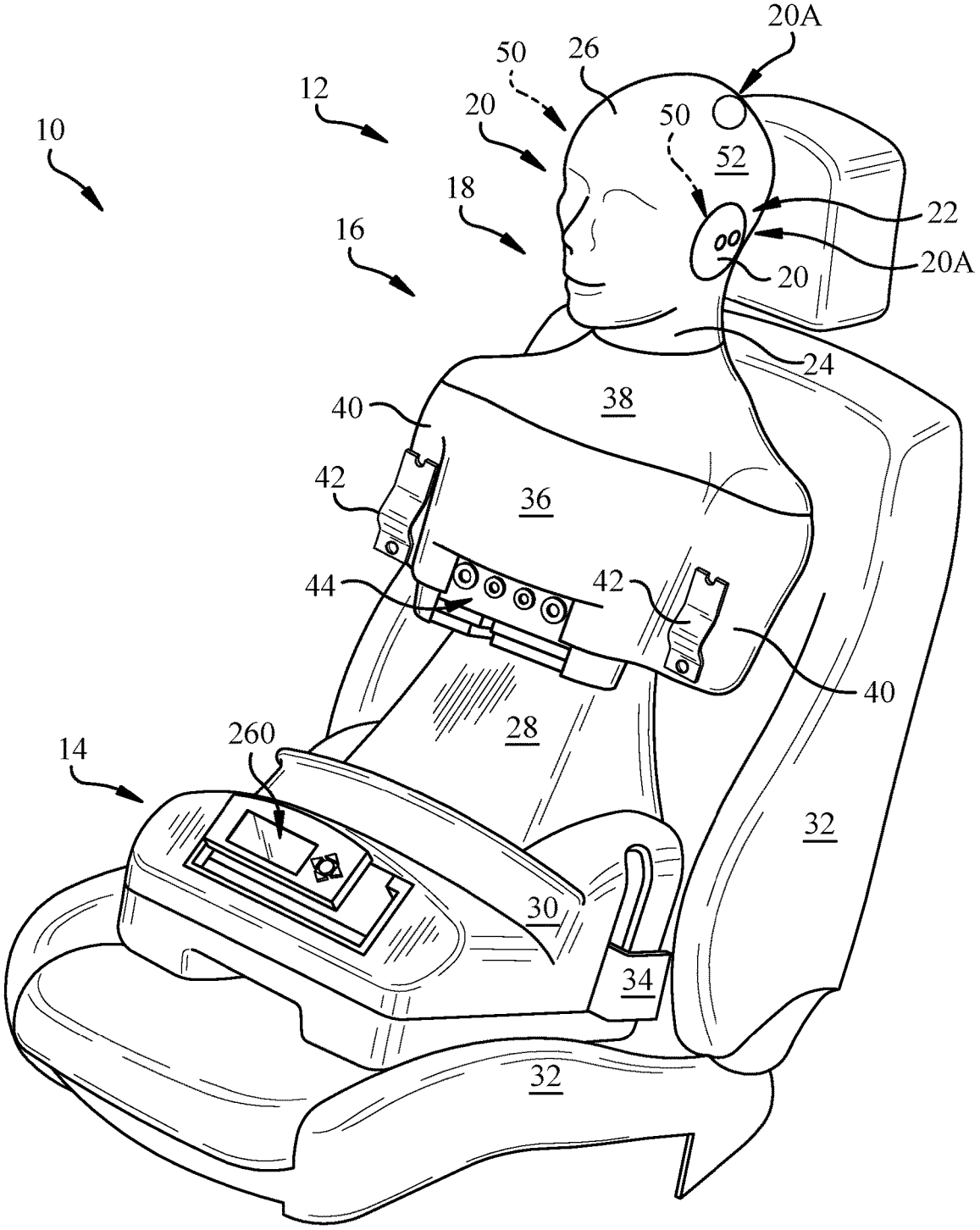
FIG. 1 is a schematic perspective view of a system for performing binaural testing according to various implementations.

It is noted that the drawings of the various implementations are not necessarily to scale. The drawings are intended to depict only typical aspects of the disclosure, and therefore should not be considered as limiting the scope of the implementations. In the drawings, like numbering represents like elements between the drawings.

DETAILED DESCRIPTION

This disclosure is based, at least in part, on the realization that a control system can be beneficially incorporated into a binaural testing apparatus. For example, a binaural testing apparatus can be programmatically controllable to modify a location of a set of microphones across a range of motion, and sample audio inputs at those microphones across that range of motion. The testing system can significantly increase the efficiency and accuracy of binaural testing when compared with conventional binaural testing apparatuses.

Commonly labeled components in the FIGURES are considered to be substantially equivalent components for the purposes of illustration, and redundant discussion of those components is omitted for clarity.

FIG. 1 is a schematic perspective view of a system 10 for performing binaural testing according to various particular implementations. In some cases, the system 10 includes a binaural test dummy (or, dummy) 12, and a control system 14 coupled with the binaural test dummy. Control system 14 is configured to incrementally modify a position of the binaural test dummy 12 across a range of motion. Aspects of the control system 14 are described further with respect to various functions of that system. As noted herein, the control system 14 can include any electro-mechanical control configuration capable of receiving control instructions (e.g., via an interface or other communication protocol), modifying a position of one or more portions of the binaural test dummy 12 across a range of motion, and initiating binaural testing using the dummy 12 across that range of motion.

The binaural test dummy 12 can include an anatomical replica of one or more positions of a human being, e.g., to enhance the accuracy of binaural testing using that dummy 12. That is, according to various implementations, the dummy 12 is sized and shaped to mimic the acoustic impedance of a human being within a testing environment. In some cases, the dummy 12 is configured for use in particular testing environments (e.g., in an automobile, airplane, theater or entertainment venue), and may be designed to interact with those environments in a similar manner as a reference human being. As used herein, the term "reference human being" can refer to an average statistical representation of a human being, in terms of physical features and acoustic impedance. That is, the reference human being can be a statistical approximation of a human being based upon one or more dimensions (e.g., height, chest/shoulder size, waist size or head circumference), as well as the acoustic impedance of the body (e.g., based upon representative clothing worn by the average human being).

In some cases, the binaural test dummy 12 is formed of one or more materials such as a non-rigid material configured to approximate an acoustic impedance and absorption of the reference human being. In particular cases, the binaural test dummy 12 is formed at least partially of a moldable or printable material such as polyurethane foam. In some cases, portions of the binaural test dummy 12 can be formed of specific materials in order to replicate the acoustic impedance of the reference human being, such that the binaural test dummy 12 is not formed of a uniform material. In particular example implementations, the acoustic impedance of the reference human being is based upon selection and verification of particular materials that mimic empirical testing of human beings (or, test subjects). For example, the reference human being can be based upon head-related transfer functions (HRTFs) of test subjects under certain test conditions. In one case, test subjects can be fitted with caps (e.g., a swim-style cap) and microphones (e.g., similar to the microphones 20 shown and described herein) and subjected to acoustic testing to determine the impedance of those people. Additional material variations can be introduced to detect particular acoustic impedance effects, e.g., of clothing, skin, or rigid material. For example, a rigid material can be added to the shoulder of the test subjects in order to compare the acoustic impedance effects from that material as compared with the test subject's shoulder.

In particular implementations, the binaural test dummy 12 has a body 16 including a head-and-neck region 18, and a set of microphones (e.g., head-mounted microphones) 20 coupled with the head-and-neck region 18. In certain cases, the microphones 20 can be coupled with the head-and-neck region 18 at anatomically correct ear locations 22 (e.g., based upon the anatomical location of ears in the reference human being). The head-and-neck region 18 can include a representation of a human neck (neck) 24, along with a representation of a human head (head) 26 extending from the neck 24. As shown, the head 26 may include features such as a nose, eye sockets, forehead, lips, chin, etc., which are intended to mimic the acoustic features of the reference human being. As described further herein, the head-and-neck region 18 can be configured to move across a plurality of positions to aid in binaural testing, and in some cases, can be moved independently of other portions of the dummy 12.

In some example implementations, the body 16 includes other anatomical representations of portions of the human physique. This body 16 can be coupled with a movable mount 28, which may in turn be coupled with a base 30. The base 30 can be sized to conform to a seat cushion 32 in a testing environment across the range of motion. That is, the base 30 can be sized (e.g., and shaped) to rest on the seat cushion 32 while the movable mount 28 and/or portions of the body 16 are moved across a range of motion to perform binaural testing in that environment. In some implementations, the base 30 can have a sufficient weight to maintain contact with the cushion 32 while the body 16 and/or movable mount 28 are manipulated to one or more positions. As described herein, portions of the control system 14 can be contained within the base 30, and can be configured to control a position of one or more portions of the body 16. Portions of the base 30 can be formed of a plastic or composite material. In some cases, the base 30 can include a coupler 34, such as an actuatable strap, mount, or bracket for connecting the base 30 with the cushion 32.

The movable mount 28 can include one or more joints, such as a ball-in-socket joint, hinge, slot/groove, etc. for permitting movement relative to the base 30. As noted herein, in various implementations, the control system 14 can include an electro-mechanical system configured to actuate the moveable mount 28 and/or other sections of the body 16 (e.g., the head-and-neck region 18) across a range of motion. The movable mount 28 can have a core formed of a metal, plastic or composite material, and in some cases, can have an outer surface formed of a material that does not significantly impact acoustic measurement, such as a flexible fabric or vinyl.

The example body 16 is shown including a thorax region 36 coupled with the moveable mount 28, a shoulder region 38 extending from the thorax region 36, where the head-and-neck region 18 extends from the shoulder region 38. In various implementations, the thorax region 36 can include at least a partial representation of a human thorax, e.g., extending from the chest area to a portion of the abdomen. The thorax region 36 can be shaped to include portions of human arms (arms) 40, and can have a thickness and width which approximate the reference human being. The thorax region 36 can further include one or more tabs 42 for connection with a microphone and/or other cable management. In some cases, the thorax region 36 includes an auxiliary interface 44 permitting connection of the microphones 20 to an external acoustic measurement system for analysis of acoustic signals received at the microphones 20. The thorax region 36 can be formed of any material described herein, for example, a plastic, rubber or foam.

The shoulder region 38, which can extend from the thorax region 36, can be shaped and sized to represent the upper chest/clavicle area, as well as the shoulders, of the reference human being. In some particular implementations, the shoulder region 38 is formed of an acoustically absorptive material configured to mimic the acoustic impedance of the reference human being wearing reference clothing. This acoustically absorptive material can include a foam such as: polyurethane or polyethylene foams. As described herein, the acoustically absorptive material can be integrated in any portion of the dummy 12, but in particular examples, may be beneficially incorporated in the shoulder region 38 to provide predictable acoustic characteristics at one or more microphones. In some implementations, the acoustically absorptive material can be demountably attached to the dummy 12, e.g., to permit adjustment of the acoustic characteristics (e.g., of the body 16).

As shown in FIG. 1, dummy 12 can further include a set (of one or more) of the microphones (e.g., head-mounted microphones) 20 coupled with the head-and-neck region 18. In some cases, as noted herein, the microphones 20 are coupled with the head 26 at the anatomically correct ear locations 22 (e.g., at the location of ears on the reference human being). According to some implementations, the head-and-neck region 18 (e.g., at head 26) includes a set of openings 50 (depicted with phantom indicator arrows as obstructed by the microphones 20) corresponding with the anatomically correct ear locations 22. In these cases, the microphones 20 can be demountably (e.g., removeably) coupled with the head-and-neck region 18 at the openings 50. That is, according to various implementations, the openings 50 can be sized to accommodate the microphones 20, and retain the microphones 20 in a position to perform binaural testing. In some example cases, the microphones 20 include, pre-polarized condenser microphones along with the associated preamplifiers. In particular examples, the microphones 20 include ½" pressure pre-polarized condenser microphones with associated preamplifier(s). The microphones 20 can include male-female mating features for connection with head-and-neck region 18 at the openings 50, e.g., via force-fitting, clips, notches/grooves, actuatable tabs, or other couplings. According to various implementations, the microphones 20 can be removable, e.g., by a human operator, and can be replaced with other like microphones 20 or different microphone configurations. In some cases, each microphone 20 (e.g., at each opening 50) can include one or more microphone units (e.g., two or more transducers).

In particular implementations, the microphones 20 are mounted approximately flush with an outer surface 52 of the head-and-neck region 18 (e.g., at head 26), such that the microphones 20 receive a smooth acoustic response without spectral coloring from pinna, ear canal resonance, etc. In certain cases, this flush-mounting is defined such that the microphones 20 protrude from, or are inset from, the outer surface 52 of the head-and-neck region 18 by less than approximately one-quarter of a wavelength of a maximum frequency of a test signal. For example, in the case of a 20 kilohertz (kHz) test signal, protrusion is defined by: ¼*(344 m/s/20 kHz)=4.3 mm; or in a 2 kHz test signal: ¼*344 m/s/2 kHz)=43 mm. In these cases, one or more microphones 20 do not include a pinna to mimic the shape of the human ear. These microphones 20 can be directionally indifferent receptors for acoustic signals. That is, in particular example implementations, these configurations can permit calculation of spectral corrections in the acoustic signals without requiring a free-field measurement, and without regard to the direction of the source of the acoustic signal. In these particular cases, where microphones 20 are flush-mounted, it is not necessary to perform the separate free-field measurement conventionally performed in correcting for spectral effects in a pinna-based microphone configuration. However, it is understood that microphones 20 are not flush-mounted according to various implementations. While the flush-mounted configuration can reduce the need to perform spectral correction (e.g., where the length of the tube from the external surface to the microphone causes a resonance, or temporal smear), various implementations can utilize microphones 20 which protrude from the outer surface 52 of the head-and-neck region 18.

As described herein, where microphone 20 includes a pinna, additional directionality calculations are more significant in calculating HRTFs. That is, in some cases, a signal coming from the front of the head-and-neck region 18 as compared with the back of the head-and neck region 18 can have significant gain due (in substantial part) to the pinna. This effect can be referred to as, "pinna shading," "pinna effect," or "pinna shadowing." For example, at frequencies above approximately 3.5 kHz, a difference between front and back signals in such a configuration can exceed 10 dB (and even up to 15+dB). In contrast, a flush-mounted microphone (e.g., a flush-mounted implementation of microphone 20) can have a relatively insignificant broadband difference between front and back signals. However, as noted herein, the sensitivity to signal modification from other portions of the anatomy (e.g., "shoulder bounce") can be higher with a flush-mounted microphone when compared with a pinna-based microphone. The use of flush-mounted microphones, despite the concern for signal modification from other anatomy, can provide a directionally agnostic receptor for acoustic signals. In these cases, the flush-mounted microphones can be effectively deployed without particular knowledge of the source direction of the acoustic signal required to correct for spectral factors.

Additionally, the pinna-based microphone configuration in conventional approaches is limited in terms of the frequency of the acoustic signal that can be effectively analyzed. In most conventional pinna configurations, the microphones do not receive enough energy above 10 kHz for quality measurements. As such, in various implementations including flush-mounted microphone(s) 20, the system 10 can effectively analyze signals with a frequency greater than approximately 10 kHz, e.g., up to approximately 20 kHz.

As noted herein, in some cases, the set of microphones 20 can include two distinct microphones 20 each located at one of the anatomically correct ear locations 22. In additional implementations, the system 10 can further include at least one additional microphone 20A (shown in phantom), which can be located at a distinct location on the head-and-neck region 18. For example, additional microphone(s) 20A can be coupled with the head-and-neck region 18 at additional locations (including, e.g., additional corresponding openings) that are horizontally offset from microphones 20, and/or vertically offset from microphones 20. An example additional microphone 20A is illustrated as vertically offset from microphones 20 in FIGS. 1 and 3, and a further additional microphone 20A is indicated as horizontally offset from microphones 20. The horizontal offset and vertical offset can be measured relative to a central location on the crown of the head 26, e.g., where a horizontal line of offset spans along the outer surface 52 along an arc that is equidistant from a central location on the crown of the head 26, and the vertical line of offset spans along the outer surface 52 between the microphones 20 and through the central location on the crown of the head 26. It is understood that various configurations of microphone(s) 20 and additional microphone(s) 20A are also possible to enable effective binaural measurement according to implementations disclosed herein.

For example, in additional implementations, microphones 20 are demountable to modify their position relative to the dummy 12. That is, in various implementations, the microphones 20 include demountable microphones that can be modified in terms of at least one of a location, an orientation, a type or a number of the set of demountable microphones 20 with respect to the dummy 12. As noted herein, these microphones can include one or more flush-mounted microphones or pinna-based microphones. In some particular implementations, control functions (e.g., performed by control subsystem as a function of control system 14 or another control architecture described herein) can be utilized to modify the location and/or position of the microphones 20 (e.g., where a microphone socket is rotatable, translatable, retractable, etc. and can be adjusted by the control system 14). Additionally, one or more microphones 20 (or additional microphones 20A) can be moved to different microphone locations on the dummy 12 (e.g., anatomically correct locations or other locations), exchanged with other microphones of a same or distinct type (for example pinna-based or flush-mounted microphones), or reoriented in the same or a distinct location. In some implementations, microphones 20 can be added to, or subtracted from, one or more microphone locations.

Figure 2:
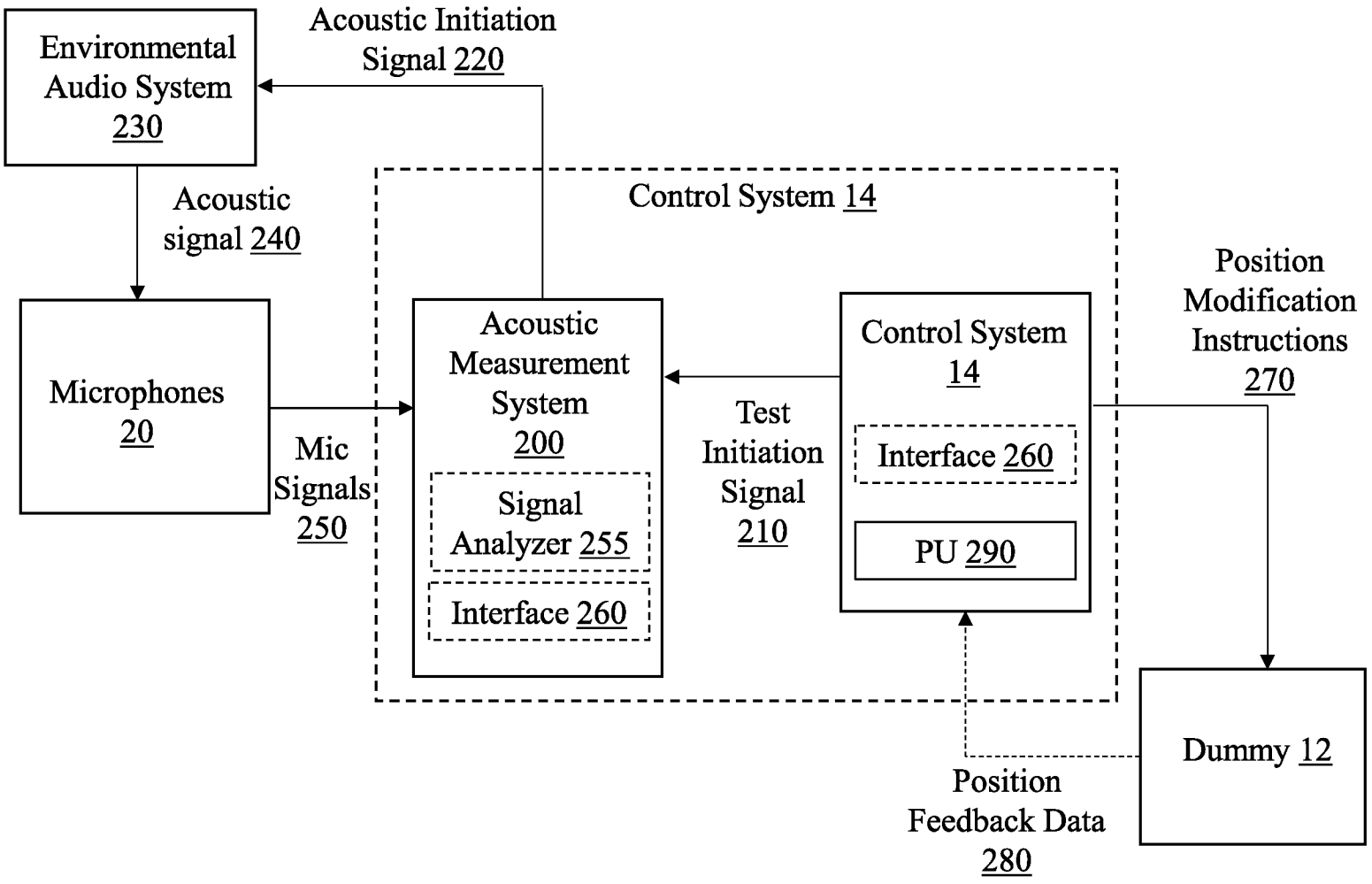
FIG. 2 is schematic data flow diagram illustrating control functions performed by a binaural testing system according to various implementations.
Figure 3:
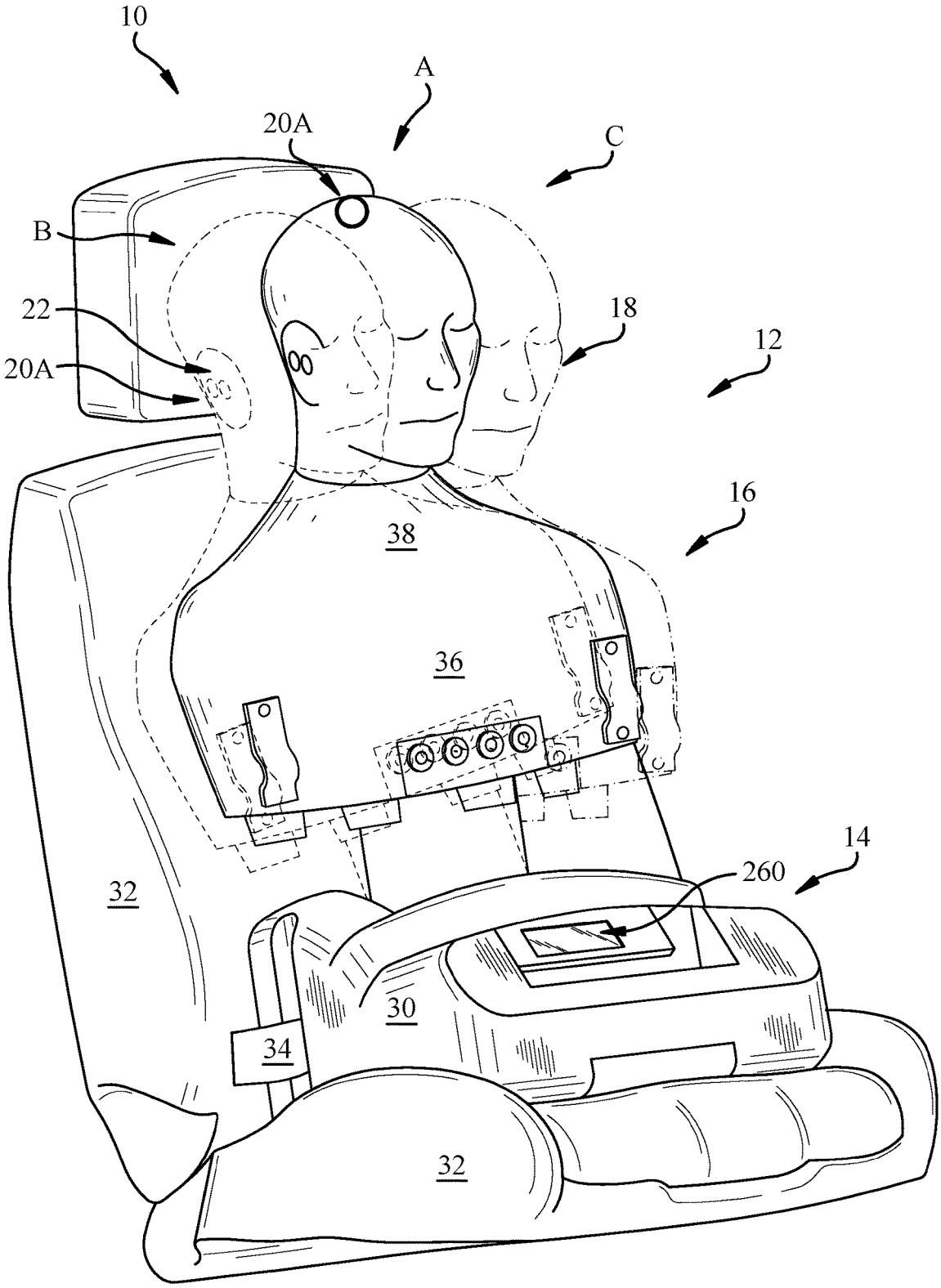
FIG. 3 shows a schematic stop-motion depiction of the system of FIG. 1 at example positions along a range of motion.

FIG. 2 is a data flow diagram illustrating various aspects of the control system 14 of FIG. 1. FIG. 3 shows a schematic stop-motion depiction of the system 10 at example positions along a range of motion. FIGS. 1-3 are referred to simultaneously.

With particular reference to FIG. 2, functions of the control system 14 are further illustrated with respect to the configuration of the system 10 within an environment. In various implementations, the control system 14 is coupled with, or includes, an acoustic measurement system 200 configured to conduct binaural testing in the environment including system 10 (enveloped acoustic measurement system 200 indicated by phantom outline). In some cases, the control system 14 is configured to send a test initiation signal 210 to the acoustic measurement system 200 in order to begin a particular portion of the binaural test. The acoustic measurement system 200 can send an acoustic initiation signal 220 to an environmental audio system 230 to trigger an acoustic signal 240 (e.g., a test signal such as playing a song or other audio file or stream) to the microphones 20 on dummy 12. The microphone signals 250 received at the microphone are then sent to the acoustic measurement system 200. In some cases, the acoustic measurement system 200 can be connected to the microphones 20 using the auxiliary interface 44 (FIG. 1) on dummy 12. The acoustic measurement system 200 can include one or more signal processing and/or analysis components, e.g., a signal analyzer 255, which can analyze the mic signal(s) 250 without the need for a corresponding free-field microphone measurement sample or a known directionality of the acoustic signal 240, as discussed herein. In some cases, the acoustic measurement system 200 includes one or more signal processors (e.g., digital signal processors, or DSPs), a beam former, an echo canceller, etc., configured to process the microphone signals 250 and measure a resulting transfer function (e.g., one or more HRTFs) of the processed signals for each of the positions of the dummy 12.

According to some implementations, the control system 14 can be configured as a central interface for controlling binaural testing within the environment. However, in other cases, the acoustic measurement system 200 can be initiated independently of the control system 14, e.g., via a separate control interface 260 for enabling control and/or communication with other components in system 10 (interfaces 260 shown as optional at both control system 14 and acoustic measurement system 200 to reflect possible distinct configurations). In some cases, as described herein, the control system 14 and the acoustic measurement system 200 are connected via a network connection (e.g., WiFi, Bluetooth, or LTE) or via any conventional wired and/or wireless connection (e.g., a network connection such as a local area network (LAN), wide area network (WAN) or personal area network (PAN)), and can share data about signal characteristics (e.g., strength, frequency) to enhance binaural testing in the environment.

In particular cases, the interface 260 at the control system 14 can include a user interface configured to enable direct control of the dummy 12, while in other cases, the interface 260 at control system 14 can include an application programming interface configured to communicate with the acoustic measurement system 200. In some cases, the acoustic measurement system 200 can be integrated within the control system 14, such that these components are commonly housed in a single unit. In other cases, the control system 14 can be deployed on a conventional computing device (e.g., a CPU) and connected with the acoustic measurement system 200 and the dummy 12.

The control system 14 can also send position modification instructions 270 to the dummy 12, and receive position feedback data 280 (in some optional implementations) about the position of the dummy 12 at a given time (e.g., on a periodic or on-demand basis). The position modification instructions 270 can include commands to adjust the position of one or more portions of the dummy 12 within the range of motion to perform binaural testing at the microphones 20. In various implementations, the control system 14 can be configured to incrementally modify a position of the dummy 12 across a range of motion (e.g., with position modification instructions 270), and (optionally) receive position feedback data 280 about the actual position of the dummy 12 within the environment. Position feedback data 280 can include data received from one or more sensors on the dummy 12 (e.g., gyroscopes, piezoelectric sensors, etc.) indicating an actual position of the dummy 12 in the environment. In some cases, position feedback data 280 can be used to calibrate and/or adjust measurements made at the microphones 20 and/or to further adjust (or correct) the position of the dummy 12.

FIG. 3 shows the system 10 in an overlay stop-motion view to illustrate functions of the control system 14. In this depiction, the control system 14 is configured to adjust the dummy 12 across a range of motion, e.g., in various positions (Position "A", Position "B", Position "C") to aid in binaural testing within the environment. These example positions are merely intended to illustrate some capabilities of the system 10, and are by no means limiting of the range of the dummy 12 and the control capabilities of the control system 14. In various implementations, the range of motion of the dummy 12 mimics movement of a human (e.g., the reference human) in an intended environment (e.g., in an automobile, airplane, theater or entertainment venue). This range of motion can include at least one of: rotation (or, yaw), pitch, roll, tilt or translation (e.g., vertical translation) of the body 16, or positioning of one or more leg(s) or arm(s) on the body 16 (e.g., coupling and/or adjusting arm(s) or leg(s) 16 with body 16). In other cases, the head-and-neck region 18 can be adjusted in terms of fore/aft movement, side-to-side movement, up/down movement, or any other head and/or neck articulation representative of the reference human motion. That is, portions of the head-and-neck region 18 (e.g., only head 26) can be independently adjusted according to particular implementations. Further, portions of the body 16 (e.g., thorax region 38 coupled with the moveable mount 30) can be adjusted to modify the ultimate location of the microphones 20 and aid in binaural testing within the environment.

In some particular cases, a method performed using the system 10 can include: I) positioning the system 10 in a testing environment (e.g., by coupling the base 30 with a cushion 32 or other environmental fixture); and II) actuating the control system 14 to initiate audio sampling at the microphones 20 in the testing environment across a plurality of positions. In various implementations, the control system 14 includes a processor (PU) 290 (FIG. 2) that is configured to perform various functions described herein. For example, the control system 14 is configured to initiate sampling of the acoustic signal 240 after positioning the dummy 12 at each of the plurality of positions in the range of motion. That is, the, the control system 14 can be programmed (e.g., at programmable processor 290) to perform the following across a range of positions:

i) Adjust the position of the dummy 12 (e.g., incrementally) to one of a plurality of positions in the range of motion;

ii) Initiate sampling of an acoustic signal 240 after positioning the dummy 12 at the selected position; and iii) Measure the transfer function of the sampled acoustic signal 240 (e.g., after processing) at the microphones 20 after the dummy 12 has been positioned. This process can be incrementally performed across the range of motion to conduct a binaural test of the environment. It is understood that measuring the transfer function of the sampled acoustic signal 240 can include measuring multiple transfer functions of that acoustic signal 240. For example, in particular implementations, a transfer function is measured for each combination of speaker, microphone and position, resulting in tens or hundreds of transfer functions across the range of motion. For example, in a configuration with four (4) microphones 20, eight (8) speakers, and eleven (11) positions, a total of 352 transfer functions will be measured across the range of motion.

The transfer functions described herein can be measured according to conventional approaches. In particular implementations, two types of transfer functions are captured. The first is a per-element (i.e., per channel or speaker) transfer function, where each channel of the system is measured. This per-element transfer function has significance in a system design, as each channel is a degree of freedom that can be used in conjunction with other channels in the system (e.g., with properties of a linear time-invariant (LTI) system and pressure superposition at the microphones). The second transfer function is a systemic measurement, which can be predicted using LTI and superposition, and verified with all channels concurrently. This measurement can be performed by dividing the system output (microphone signal) by the system reference input (electrical input signal to the amplifier).

In additional implementations, the control system 14 can be configured to adjust the position of a seat (e.g., seat cushion 32) or other surface upon which the dummy 12 rests or contacts. For example, in some implementations, the control system 14 can be coupled (e.g., via any mechanical, electrical or communication-based mechanism described herein) with control system in a seat, and can be configured to initiate movement of the seat along with the dummy 12 to reposition the dummy 12 and perform binaural testing.

Control system 14 may be mechanically or electrically connected to the dummy 12 such that control system 14 may actuate one or more components in the dummy 12 (e.g., the head-and-neck region 18 or the movable mount 30). Control system 14 may actuate movement of the dummy 12 in response to a command received locally, e.g., at the interface 260, or via a network-connected device. That is, the control system 14 can be configured to receive commands from a network connected device such as a remote control, smartphone, tablet, wearable electronic device, voice-controlled command system, etc., and may communicate over any network connection (e.g., cloud-based or distributed computing system). As noted herein, control system 14 may include computerized, mechanical, or electro-mechanical devices capable of actuating mechanical controls in the dummy 12.

In one implementation, control system 14 may be a computerized device capable of providing operating instructions to dummy 12. In this case, control system 14 may be configured to receive commands to initiate (or otherwise perform) binaural testing in an environment (e.g., via interface 260 or other network-connected device), and provide operating instructions (e.g., position modification instructions 270) to dummy 12 to modify the position of the dummy 12 based upon the planned test. In this embodiment, dummy 12 may include electro-mechanical components, capable of receiving position modification instructions 270 (electrical signals) from control system 14 and producing mechanical motion (e.g., tilt, rotation, fore/aft movement) in a portion of the body 16. In another implementation, control system 14 may be an electro-mechanical device, capable of electrically monitoring (e.g., with sensors) parameters indicating the position of the dummy 12, and mechanically actuating the dummy 12 to reach a desired testing position.

It is understood that the system 10 and approaches described herein can be utilized for binaural testing in a variety of environments. In the example of an automobile environment, conventional binaural testing apparatuses require a multitude of measurements (e.g., 10 or more) related to different audio output locations (e.g., speakers) and their distances from receiving microphones in order to conduct a test that is robust over typical seating locations. Given the number of possible positions that a human user can take within this example environment, the conventional approach for binaural testing can become extremely labor and time-intensive, as well as prone to measurement and placement-based error (e.g., due to improper or inconsistent placement of a dummy by an operator). As described herein, the system 10 and related approaches according to various implementations can significantly improve the efficiency and accuracy of these binaural tests relative to these conventional approaches.

It is further understood that the system 10 and related approaches could be used to mimic not only the human user binaural response, but also that of other users in the environment. For example, humanoid robotic users or other robotic systems with auditory receptors can be configured to send/receive acoustic signals and interact with the system 10. In the case of sending acoustic signals, a mouth simulator following a known standard (e.g. ITU-T P.51) can be used. Automated motion on the dummy in this case can assist with the testing of system acoustic inputs such as microphones used for in-system telephony and voice pickup for system commands, digital assistants, etc. In some example implementations, the system 10 can be adapted to either represent a robotic system (e.g., humanoid robot) or to interact with an environment including such a robotic system. In these cases, the system 10 can be configured to mimic the acoustic impedance of the robotic system and/or to account for the acoustic impedance of nearby robotic systems. For example, a fully programmable humanoid robot can enter the testing environment, automatically position itself, and initiate the measurement for each position when ready. This example configuration can leverage the automation efficiency of system 10, and further enhance that efficiency. Such a system could enable repeatable transfer function evaluation beyond conventional configurations, including detailed head, torso, and limb positioning. One example is the effect (e.g., of arms) where the arm blocks "line-of-sight" to the microphones when using a high-mounted door speaker. Another example is the effect of leg positioning on a low-mounted door speaker. A final example is that of a driver seat near-field speaker transfer function to another occupant with and without a dummy positioned in the driver seat.

The functionality described herein, or portions thereof, and its various modifications (hereinafter "the functions") can be implemented, at least in part, via a computer program product, e.g., a computer program tangibly embodied in an information carrier, such as one or more non-transitory machine-readable media, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing all or part of the functions can be performed by one or more programmable processors executing one or more computer programs to perform the functions of the calibration process. All or part of the functions can be implemented as, special purpose logic circuitry, e.g., an FPGA and/or an ASIC (application-specific integrated circuit). Processors suitable for the execution of a computer program include, by way of example, both general and special purpose microprocessors, and any one or more processors of any kind of digital computer. Generally, a processor will receive instructions and data from a read-only memory or a random access memory or both. Components of a computer include a processor for executing instructions and one or more memory devices for storing instructions and data.

Additionally, actions associated with implementing all or part of the functions described herein can be performed by one or more networked computing devices. Networked computing devices can be connected over a network, e.g., one or more wired and/or wireless networks such as a local area network (LAN), wide area network (WAN), personal area network (PAN), Internet-connected devices and/or networks and/or a cloud-based computing (e.g., cloud-based servers).

In various implementations, components described as being "coupled" to one another can be joined along one or more interfaces. In some implementations, these interfaces can include junctions between distinct components, and in other cases, these interfaces can include a solidly and/or integrally formed interconnection. That is, in some cases, components that are "coupled" to one another can be simultaneously formed to define a single continuous member. However, in other implementations, these coupled components can be formed as separate members and be subsequently joined through known processes (e.g., soldering, fastening, ultrasonic welding, bonding). In various implementations, electronic components described as being "coupled" can be linked via conventional hard-wired and/or wireless means such that these electronic components can communicate data with one another. Additionally, sub-components within a given component can be considered to be linked via conventional pathways, which may not necessarily be illustrated.

A number of implementations have been described. Nevertheless, it will be understood that additional modifications may be made without departing from the scope of the inventive concepts described herein, and, accordingly, other implementations are within the scope of the following claims.

We claim:

1. A system comprising:

a binaural test dummy comprising:

a body having:

a head-and-neck region;

a set of head-mounted microphones coupled with the head-and-neck region at anatomically correct ear locations;

a base; and a movable mount coupled with the base and the body; and a control system coupled with the binaural test dummy for incrementally modifying a position of the body and the movable mount across a range of motion, wherein the range of motion includes at least one of a front-to-back direction or a side-to-side direction relative to the base, wherein the base is sized to conform to a seat cushion in a testing environment across the range of motion and remain substantially stationary on the seat cushion while the control system incrementally modifies the position of the body and the movable mount across the range of motion.

2. The system of claim 1, wherein the range of motion mimics movement of a human in an intended environment, and comprises at least one of: rotation, pitch, roll, tilt or translation of the body, or positioning at least one leg or at least one arm on the body.

3. The system of claim 2, wherein the control system is configured to:

modify the position of the body and the movable mount across a plurality of positions in the range of motion; and measure a transfer function of an acoustic signal received at the set of head-mounted microphones at the plurality of positions in the range of motion.

4. The system of claim 1, wherein the body further comprises:

a thorax region coupled with the movable mount; and a shoulder region between the thorax region and the head-and-neck region.

5. The system of claim 1, wherein a region of the binaural test dummy comprises a non-rigid material configured to mimic an acoustic impedance and absorption of a reference human being.

6. The system of claim 1, wherein the head-and-neck region comprises a set of openings corresponding with the anatomically correct ear locations, and wherein the set of head-mounted microphones are demountably coupled with the set of openings.

7. The system of claim 1, further comprising at least one additional head-mounted microphone coupled with the head-and-neck region at a distinct location from each of the set of head-mounted microphones, wherein the at least one additional head-mounted microphone is either horizontally offset from the set of head-mounted microphones or vertically offset from the set of head-mounted microphones.

8. The system of claim 1, wherein the control system is coupled with a base of the binaural test dummy, and wherein the control system further comprises: a user interface configured to enable direct control of the binaural test dummy, or an application programming interface configured to communicate with an acoustic measurement system.

9. The system of claim 1, wherein the set of head-mounted microphones are mounted substantially flush with an outer surface of the head-and-neck region, and wherein the set of head-mounted microphones protrude from, or are inset from, the outer surface of the head-and-neck region by less than one-quarter of a wavelength of a maximum frequency of a test signal.

10. The system of claim 1, wherein the control system further comprises:

a signal analyzer for analyzing an acoustic signal sampled at the set of head-mounted microphones, wherein the set of head-mounted microphones permits the signal analyzer to analyze the sampled acoustic signal without a corresponding free-field microphone measurement sample and without regard to a direction of a source of the acoustic signal.

11. The system of claim 10, wherein the control system is configured to:

control a movement of the body and the movable mount across a plurality of positions in the range of motion; and initiate the sampling of the acoustic signal after positioning the binaural test dummy at each of the plurality of positions in the range of motion.

12. The system of claim 1, further comprising a control sub-system coupled with the binaural test dummy, wherein the control sub-system is configured to modify at least one of a location or an orientation of the set of head-mounted microphones.

13. The system of claim 1, wherein the base has a sufficient weight to maintain contact with the seat cushion while the moveable mount and the body are manipulated to a plurality of positions across the range of motion.

14. The system of claim 1, wherein the base further comprises a coupler for connecting with the seat cushion.

15. A method comprising:

positioning a binaural measurement system in a testing environment, the binaural measurement system comprising:

a binaural test dummy comprising:

a body having:

a head-and-neck region; and a set of head-mounted microphones coupled with the head-and-neck region at anatomically correct ear locations;

a base; and a movable mount coupled with the base and the body;

a control system coupled with the binaural test dummy; and an acoustic measurement system coupled with the control system;

actuating the control system to send a test initiation signal to the acoustic measurement system for each of a plurality of positions of the body and the movable mount across a range of motion, wherein the range of motion includes at least one of a front-to-back direction or a side-to-side direction relative to the base, wherein the base is sized to conform to a seat cushion in a testing environment across the range of motion and remain substantially stationary on the seat cushion while the control system incrementally modifies the position of the body and the movable mount across the range of motion;

sending an acoustic initiation signal from the acoustic measurement system to an environmental audio system in response to receiving the test initiation signal, the acoustic initiation signal instructing the environmental audio system to output acoustic signals;

receiving the acoustic signals from the environmental audio system at the set of head-mounted microphones while the binaural test dummy is in the plurality of positions in the range of motion; and measuring a transfer function of the received acoustic signals for each of the plurality of positions of the body and the movable mount.

16. The method of claim 15, wherein the acoustic measurement system comprises a signal analyzer configured to analyze the received acoustic signals from the set of head-mounted microphones without a corresponding free-field microphone measurement sample and without regard to a direction of a source of the received acoustic signals.

17. The method of claim 15, further comprising sending position modification instructions from the control system to the binaural test dummy to adjust the position of the body and the movable mount between the plurality of positions across the range of motion.

18. A binaural test dummy comprising:

a body having;

an anatomically correct head-and-neck region;

a base; and a movable mount coupled with the base and the body;

a set of head-mounted microphones coupled with the head-and-neck region of the body at anatomically correct ear locations, wherein the set of head-mounted microphones are directionally indifferent receptors for acoustic signals, wherein the set of head-mounted microphones are mounted substantially flush with an outer surface of the head-and-neck region, and wherein the set of head-mounted microphones protrude from, or are inset from, the outer surface of the head-and-neck region by less than one-quarter of a wavelength of a maximum frequency of a test signal; and a control system coupled with the base for incrementally modifying a position of the body and the movable mount across a range of motion, wherein the range of motion includes at least one of a front-to-back direction or a side-to-side direction relative to the base, and wherein the base is sized to conform to a seat cushion in a testing environment across the range of motion and remain substantially stationary on the seat cushion while the control system incrementally modifies the position of the body and the movable mount across the range of motion.

19. The binaural test dummy of claim 18, wherein a portion of the body includes an acoustically absorptive material.

20. The binaural test dummy of claim 18, further comprising at least one additional head-mounted microphone coupled with the head-and-neck region at a distinct location from each of the set of head-mounted microphones.

21. The binaural test dummy of claim 20, wherein the at least one additional head-mounted microphone is either horizontally offset from the set of head-mounted microphones or vertically offset from the set of head-mounted microphones.

22. A system comprising:

a binaural test dummy having:

a body;

a set of demountable microphones coupled with the body;

a base; and a movable mount coupled with the base and the body, wherein a configuration of the set of demountable microphones is modifiable to change at least one of a location, an orientation, a type or a number of the set of demountable microphones; and a control system coupled with the binaural test dummy, the control system comprising a programmable processor that is programmed to:

adjust a position of the body and the movable mount to a plurality of positions in a range of motion, wherein the range of motion includes at least one of a front-to-back direction or a side-to-side direction relative to the base;

initiate sampling of an acoustic signal at the set of demountable microphones at each of the plurality of positions in the range of motion; and measure a transfer function of the sampled acoustic signal at each of the plurality of positions in the range of motion, wherein the base is sized to conform to a seat cushion in a testing environment across the range of motion and remain substantially stationary on the seat cushion while the control system incrementally modifies the position of the body and the movable mount across the range of motion.

23. The system of claim 22, wherein the set of demountable microphones comprises at least one of a flush-mounted microphone or a pinna-based microphone.

24. The system of claim 22, wherein measuring the transfer function of the sampled acoustic signal at each of the plurality of positions comprises measuring multiple transfer functions, each of the multiple transfer functions representing a respective combination of speaker, microphone and position.

* * * * *